US008123591B2

(12) United States Patent
Olsen

(10) Patent No.: US 8,123,591 B2
(45) Date of Patent: Feb. 28, 2012

(54) ABRASIVE PUMP FOR AN ABRASIVE JET CUTTING MACHINE

(75) Inventor: John H. Olsen, Vashon, WA (US)

(73) Assignee: Omax Corporation, Kent, WA (US)

( * ) Notice: Subject to any disclaimer, the term of this patent is extended or adjusted under 35 U.S.C. 154(b) by 960 days.

(21) Appl. No.: 12/079,783

(22) Filed: Mar. 28, 2008

(65) Prior Publication Data

US 2009/0247048 A1 Oct. 1, 2009

(51) Int. Cl.

| | |
|---|---|
| ***B24B 1/00*** | (2006.01) |
| ***B24B 49/00*** | (2006.01) |
| ***B24B 51/00*** | (2006.01) |
| ***B24C 7/00*** | (2006.01) |

(52) U.S. Cl. ..... 451/2; 451/5; 451/8; 451/60; 451/99

(58) Field of Classification Search ..... 451/2, 5, 451/8, 38, 39, 40, 60, 90, 99, 446
See application file for complete search history.

(56) References Cited

U.S. PATENT DOCUMENTS

| | | | | |
|---|---|---|---|---|
| 3,201,901 | A * | 8/1965 | Pauli | 451/99 |
| 3,834,082 | A * | 9/1974 | Grudzinski | 451/99 |
| 4,075,789 | A * | 2/1978 | Dremann | 451/99 |
| 4,821,467 | A * | 4/1989 | Woodson et al. | 451/2 |
| 6,083,001 | A * | 7/2000 | Deardon et al. | 433/88 |
| 2008/0110311 | A1 | 5/2008 | Stangherlin | |
| 2009/0064832 | A1 | 3/2009 | Caretta et al. | |

OTHER PUBLICATIONS

"Carinox S.A. Purchases Third Waterjet Cutting Machine from Flow", Kent, Wash.—(Business Wire)—Dec. 18, 2003, p. 1, http://www.businesswire.com/news/home/20031218005772/en/Carinox.

"Operation Manual Abrasive Delivery System TYPE ADS-24-11", Straaltechniek International B.V., Flow Europe GmbH Jul. 2000, pp. 28.

* cited by examiner

*Primary Examiner* — Timothy V Eley
(74) *Attorney, Agent, or Firm* — Bryan A. Santarelli; Graybeal Jackson LLP

(57) ABSTRACT

An abrasive supply system may, for example, be used to supply abrasive particles such as garnet to a cutting nozzle of an abrasive jet cutter. According to an embodiment, the abrasive is propelled by a substantially constant flow rate gas source. According to an embodiment, the system may be supplied with abrasive from an atmospheric pressure abrasive hopper. According to an embodiment, a controller automatically actuates refilling of an abrasive tank from the abrasive hopper, and then automatically closes an abrasive supply valve and restarts abrasive propulsion. According to an embodiment, the controller may include or consist of pneumatic logic.

25 Claims, 7 Drawing Sheets

ABRASIVE PUMP FOR AN ABRASIVE JET CUTTING MACHINE

BACKGROUND

An abrasive jet cutter generally operates by focusing a high pressure jet of fluid carrying entrained abrasive particles onto a work surface.

Abrasive jet cutting machines generally have a relatively small abrasive hopper near the cutting nozzle sufficient to supply the jet for less than 30 minutes. For production work, it is desirable to automatically fill this small hopper from a larger abrasive source.

Commonly, a large pressure pot of the type commonly used for sandblasting is filled with several hundred to a few thousand pounds of abrasive and then pressurized with air to around 50 psi. The air pressure forces the abrasive to flow through a small hose to the smaller hopper near the nozzle. When the small hopper is full, the abrasive around the hose outlet stops further abrasive from coming and the flow ceases.

OVERVIEW

According to an embodiment, an abrasive jet cutting system includes an abrasive hopper that may be left at or substantially at atmospheric pressure.

According to an embodiment, an abrasive jet cutting system includes an abrasive delivery system having an abrasive tank configured to alternately 1) receive abrasive from an abrasive hopper substantially at atmospheric pressure and 2) provide abrasive under pressure for delivery to an abrasive jet cutting head. The abrasive tank may receive air through a substantially constant flow source, such as a needle valve.

According to an embodiment an abrasive jet cutting system includes an abrasive delivery system configured to automatically fill an abrasive tank when empty and automatically resume pressurization of the abrasive tank when refilled. According to an embodiment, the abrasive delivery system is automated using pneumatic components.

DETAILED DESCRIPTION

Figure 1:
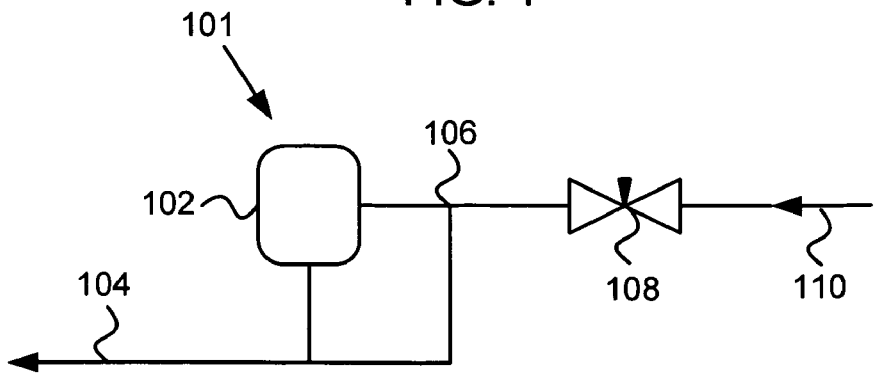
FIG. 1 is a diagram of an abrasive supply system for conveying abrasive particles with a substantially constant flow rate gas source, according to an embodiment.

The following discussion is presented to enable a person skilled in the art to make and use the claimed invention. Various modifications to the disclosed embodiments will be readily apparent to those skilled in the art, and the generic principles herein may be applied to other embodiments and applications without departing from the spirit and scope of the present invention as defined by the appended claims. Thus, the present invention is not intended to be limited to the embodiments shown, but is to be accorded the widest scope consistent with the principles and features disclosed herein.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented here.

FIG. 1 is a diagram of an abrasive supply system 101 for conveying abrasive particles with a substantially constant flow rate gas source 106, according to an embodiment. The substantially constant flow rate gas source 106 is configured to pressurize an abrasive tank 102 that may hold abrasive particles. The substantially constant flow rate gas source 106 is further configured to convey gas-entrained abrasive particles through an abrasive delivery tube 104.

Typically, the air flow required to push the abrasive particles through the abrasive delivery tube 104 is small. The frictional effects of the abrasive particles moving through the abrasive delivery tube creates a back pressure sufficient to cause a relatively significant pressure rise at the substantially constant flow rate gas source 106 and the abrasive tank to, for example, a value between about 10 and 50 psig. As long a enough abrasive remains in the abrasive tank 102 to continue delivering abrasive particles to the abrasive delivery tube, the back pressure of the flowing abrasive particles maintains the gas pressure at the substantially constant flow rate gas source 106 and in the abrasive tank 102. However, as the abrasive tank 102 empties and the abrasive particles are purged from the abrasive delivery tube 104, the back pressure decreases and the pressure at the substantially constant flow rate gas source 106 and abrasive tank drops significantly.

This self-regulation of pressure, wherein the gas pressure in the abrasive tank 102 and at the inlet end of the abrasive supply tube drops when the abrasive is exhausted, tends to prevent the abrasive particles remaining in the distal end (not shown) of the abrasive delivery tube 104 from being blown out the distal end of the abrasive delivery tube. In contrast, blowing abrasive particles out of the distal end of the abrasive delivery tube is one unfortunate effect that may arise from the use of a substantially constant pressure gas source rather than a substantially constant flow rate gas source.

According to an embodiment, a metering valve 108 may receive gas from a substantially constant pressure gas source 110 to produce the substantially constant flow rate gas source 106. For example, air may be received at 110 from an air compressor or a shop air system (not shown) at a pressure typical for such systems, for example at about 60 to 120 psig. The metering valve 108 may include a needle valve adjusted or selected to produce a gas flow rate appropriate for delivering abrasive particles to the distal end (not shown) of the abrasive delivery tube 104 at a rate appropriate for an application. For example, for a typical abrasive jet cutting apparatus, the metering valve 108 may produce a gas flow rate of about 10 liters per min to deliver garnet abrasive particles to a cutting nozzle at a rate of about 1 pound per minute.

Figure 2:
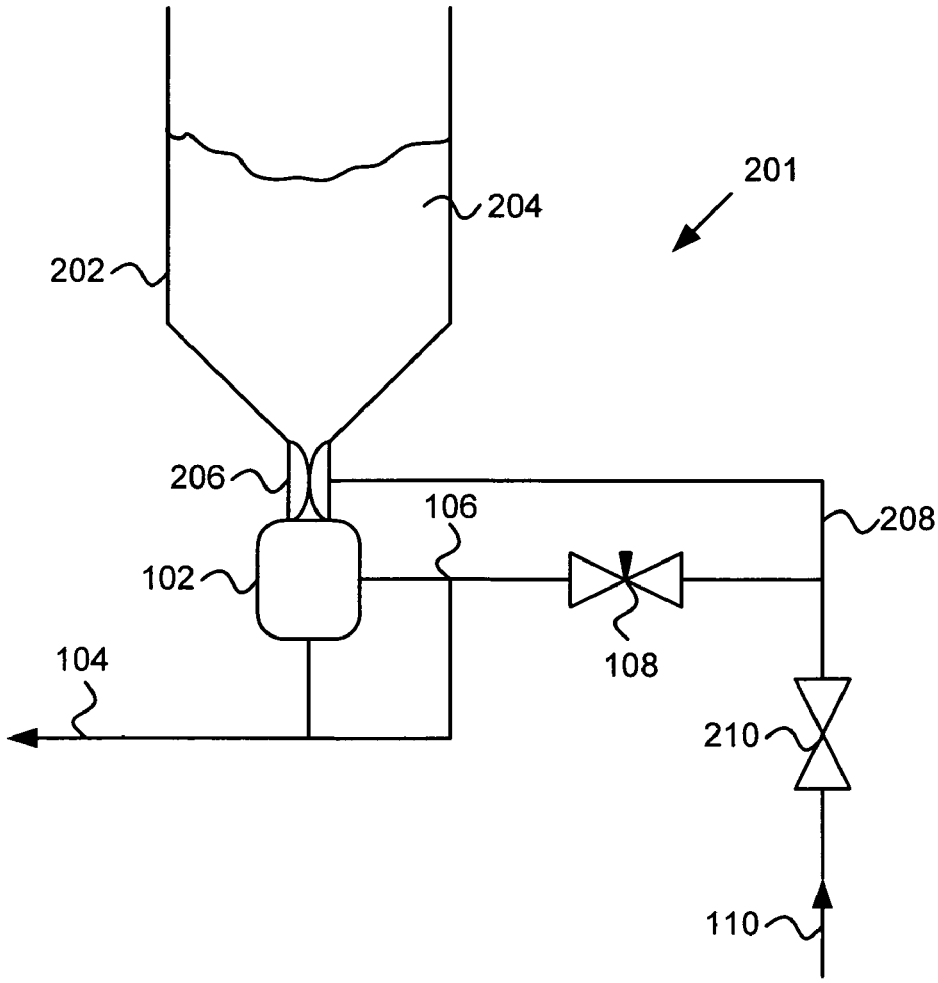
FIG. 2 is a diagram of an abrasive supply system including an atmospheric pressure abrasive hopper, and a control valve for controlling a substantially constant flow rate gas source and an abrasive supply valve, according to an embodiment.

FIG. 2 is a diagram of an embodiment of an abrasive supply system 201 that includes provision for refilling the abrasive tank 102 with abrasive particles 204 from a large abrasive hopper 202, which may typically be maintained substantially at atmospheric pressure. A control valve 210 (which may alternatively be configured as more than one control valve) is configured to open or close to respectively pass or stop gas from the substantially constant pressure gas source 110 from reaching a switched substantially constant pressure node 208.

When the control valve 210 is open, pressure is maintained at node 208, and thus the metering valve 108 continues to maintain flow through the abrasive delivery tube 104 and, if abrasive particles remain in the tube, pressurize the abrasive tank 102. Pressure at node 208 also keeps an abrasive supply valve 206 closed, which prevents air pressure from the abrasive supply tank 102 from leaking out through the abrasive hopper 202. According to an alternative embodiment, node 208 may be split, with one node providing gas flow to the metering valve 108 and another node providing gas flow to the abrasive supply valve 206.

When the control valve 210 is closed, the pressure at node 208 drops, for example due to continued flow through the metering valve 108. A drop in pressure at node 208 opens the abrasive supply valve 206 to selectively admit abrasive particles 204 from the abrasive hopper 202 to the abrasive tank 102. After a desired amount of abrasive particles 204 have flowed from the abrasive hopper 202 to the abrasive tank 102, the control valve 210 may be opened to restore pressure to node 208. In turn, restoration of pressure at node 208 closes the abrasive supply valve 206 and begins gas flow through the metering valve 108. Since there are again abrasive particles in the abrasive tank 102 to flow into and through the abrasive delivery tube 104, the air flow through the substantially constant flow rate gas source 106 causes a pressure rise to pressurize the abrasive tank 102 and the inlet end of the abrasive delivery tube 104. Thus, the control valve 210 is configured to selectively close the abrasive supply valve 206 when there is gas flow through the metering valve 108 or open the abrasive supply valve 206 when there is substantially no gas flow through the metering valve 108.

The abrasive tank 102 may be configured to hold a relatively small amount of abrasive particles, such as about 1 gallon. A small abrasive tank 102 requires only relatively thin walls to withstand an operating pressure of about 10 psig to about 50 psig. A small abrasive tank 102 may help avoid dealing relatively onerous pressure vessel safety standards typically associated with a large pressure vessel, such as a large pressurized abrasive hopper.

Compared to prior art systems, the abrasive supply system 201 does not require pressurization of the abrasive hopper 202. This allows the elimination of an expensive and heavy-walled large pressure vessel. For example, a typical prior art pressurized abrasive hopper may be about 3 feet diameter by 4 feet high, and have walls made of ½ inch steel plate. Instead, the abrasive hopper 202 may be formed from a low cost polyethylene tank which is not pressurized. The abrasive hopper 202 has a conical bottom that allows the abrasive particles 204 to flow by gravity to a central discharge hole. Immediately below the central discharge hole is the abrasive supply valve 206 that can shut off the abrasive flow and resist an air pressure below it or open to allow gravity flow of the abrasive particles 204 from the abrasive hopper 202 to the abrasive tank 102. A bladder-type pinch valve has been found to work well as an abrasive supply valve 206.

Figure 3A:
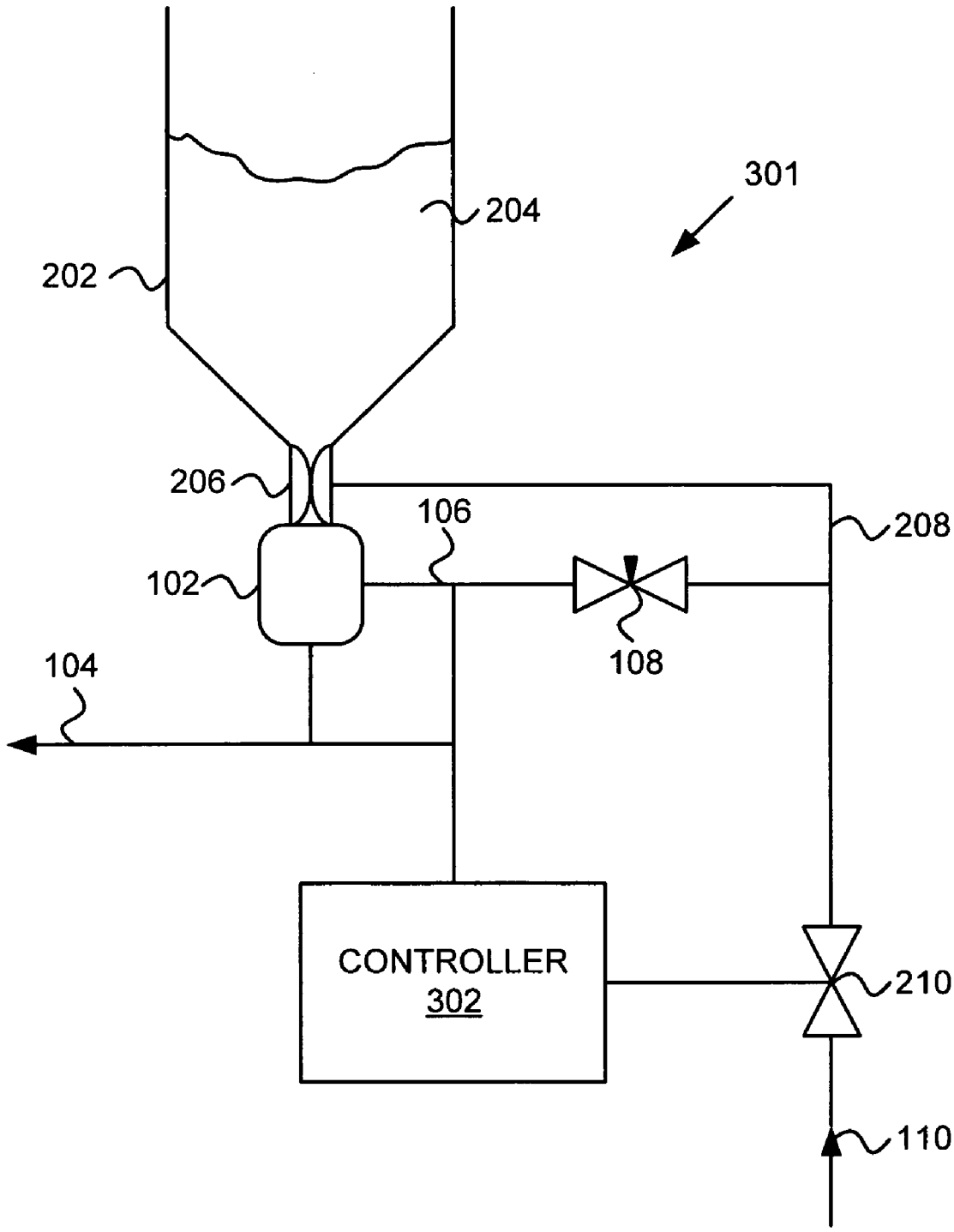
FIG. 3A is a diagram of an abrasive supply system with a controller configured for automatic control of a substantially constant flow rate gas source and an abrasive supply valve, according to an embodiment.

FIG. 3A is a diagram of an abrasive supply system 301 configured for automatic control, according to an embodiment. A controller 302 is operatively coupled to receive a pressure signal from the substantially constant flow rate node 106. Responsive to a drop in pressure precipitated by the emptying of abrasive from the abrasive tank 102 and related decrease in back pressure within the abrasive delivery tube 104, the controller is configured to shut the control valve 210. As described above, closing the control valve 210 reduces the pressure at node 208, which substantially stops flow through the metering valve 108, thereby depressurizing the abrasive tank 102 to substantially atmospheric pressure. Shutting the control valve 210 and resultant drop in pressure at node 208 is further operative to open the abrasive supply valve 206 to allow abrasive particles 204 to flow from the abrasive hopper 202 to the abrasive supply tank.

After a time, the gravity flow of abrasive particles at least partially refills the abrasive tank 102. According to an embodiment, it may be preferred to substantially refill without overfilling the abrasive tank 120. According to an embodiment a bladder-type pinch value may be used as the abrasive supply value 206. It has been found that overfilling the abrasive tank 120 may tend to pinch an excessive amount of abrasive between the bladders of the pinch valve 206 and thus damage or decrease the service life of the valve 206.

When the abrasive tank 102 has been sufficiently refilled, such as after an amount of time corresponding to sufficient refilling, the controller 302 again actuates the control valve 210 to open and reestablish a connection between the gas source 110 and the node 208. Of course, when node 208 is again pressurized, the abrasive supply valve 206 closes to stop the flow of abrasive and maintain the pressure of the abrasive tank 102; and the metering valve 108 again establishes a substantially constant gas flow rate at node 106 to pressurize the abrasive tank 102 and propel the abrasive particles through the abrasive delivery tube 104.

Figure 4:
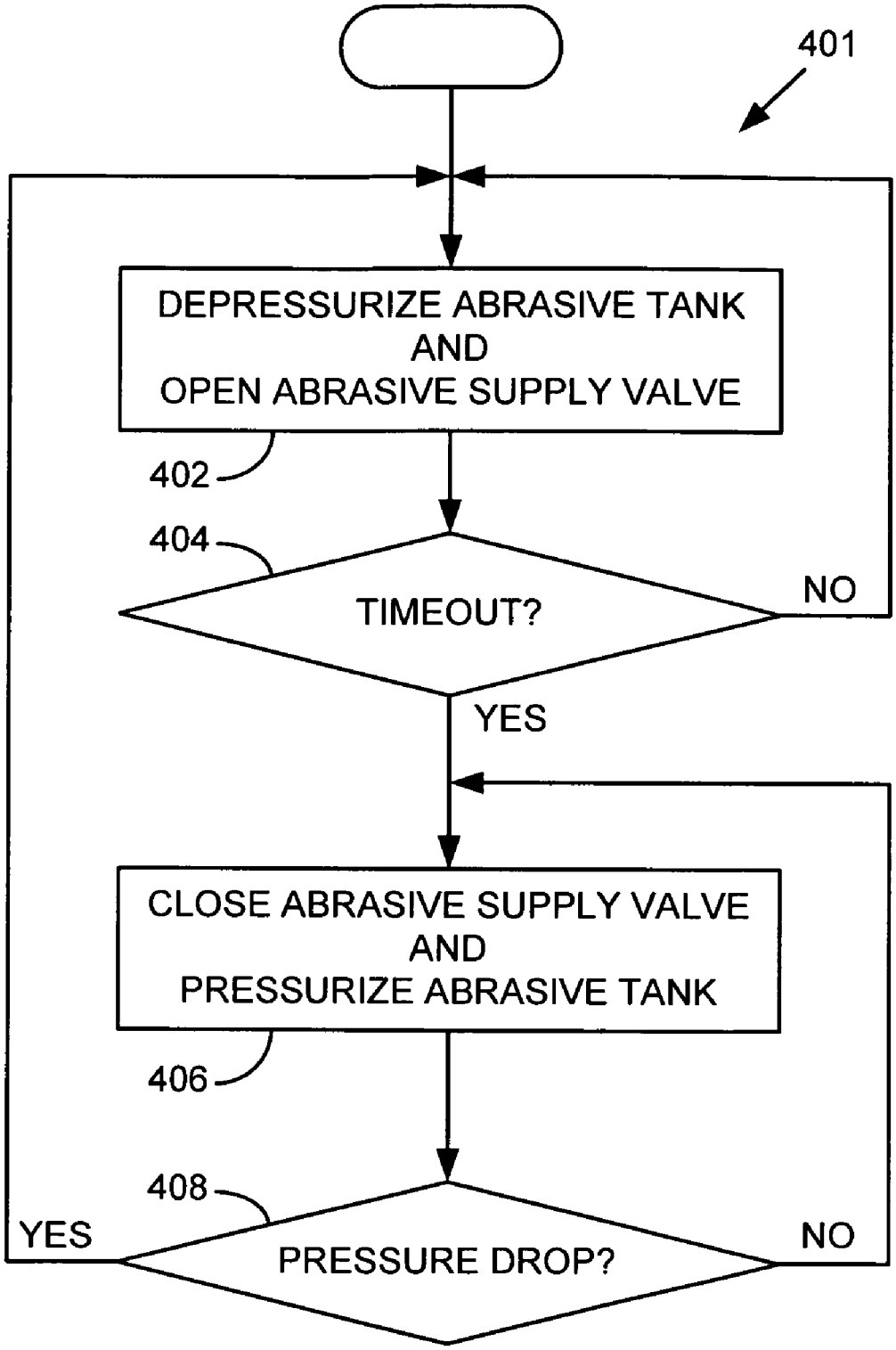
FIG. 4 is a flow chart illustrating a control algorithm for the controller of FIGS. 3A, 3B, and 5-7, according to an embodiment.

An embodiment of a process corresponding to the behavior of the controller 302 is shown in the flow chart 401 of FIG. 4. In step 402, the control valve 210 is closed to depressurize the abrasive tank 102 (and stop propulsion of abrasive particles in the abrasive delivery tube 104). During the state corresponding to step 402, the abrasive tank 102 refills with abrasive and abrasive propulsion through the abrasive delivery tube is suspended. The state corresponding to step 402 may be referred to as the refill state. The system remains in the state corresponding to step 402 until a condition for decision step 404 is satisfied. According to an embodiment, the controller may monitor the amount of abrasive in the abrasive tank and/or the flow of abrasive into the abrasive tank to determine when the condition is satisfied for step 404. According to another embodiment, a timer may be set to allow a predetermined time for flow of abrasive into the abrasive tank. The condition for step 404 is then satisfied by the passage of the predetermined time.

After the condition of step 404 is satisfied, the process proceeds to step 406. At the beginning of step 406, the control valve is opened again to close the abrasive delivery valve 206 and begin or resume the flow of gas through the metering valve 108 to pressurize the abrasive tank 102 and propel abrasive particles through the abrasive supply tube 104. During the state corresponding to step 404, the system continues to propel abrasive particles from the abrasive tank. A resume mechanism (not shown) in the controller 302 of FIG. 3A may be configured to initiate the transition from the state corresponding to step 402 to the state corresponding to step 406.

According to an example, the state corresponding to step 402 (and hence a corresponding timeout value) may last about 10 seconds. According to an example, the state corresponding to step 406 may typically last about 1-3 minutes until exhaustion of the abrasive supply in the abrasive tank 102 again causes the pressure at node 106 to drop. Proceeding to step 408, when a pressure drop is sensed at node 106, the process again proceeds to step 402, and the process is repeated.

Figure 3B:
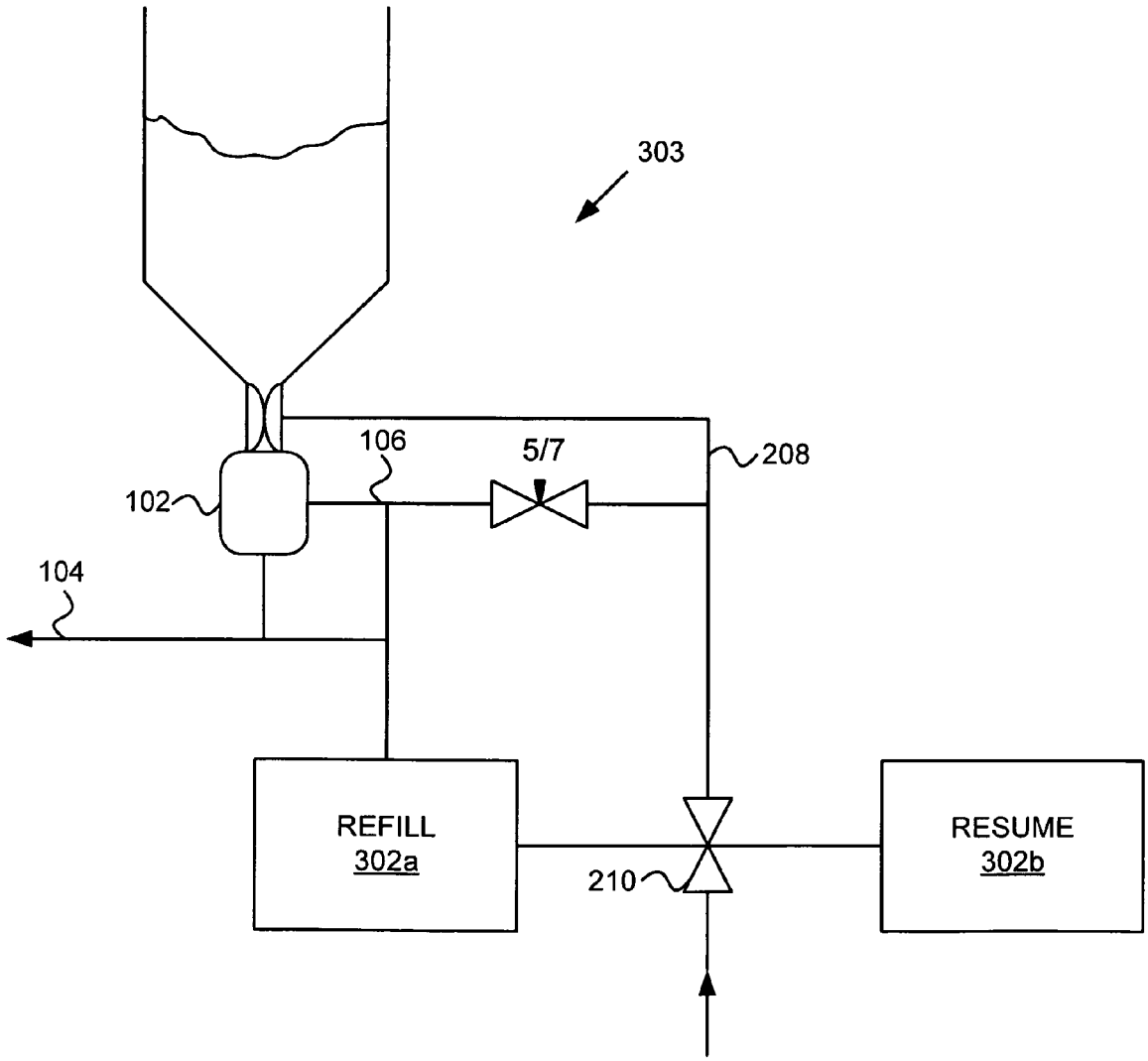
FIG. 3B is a diagram of an abrasive supply system with a split controller including a refill controller and a resume controller, according to an embodiment.

According to an embodiment, depicted in FIG. 3B as system 303, functional portions of the controller 302 corresponding respectively to the behavior of steps 408 and 404 of FIG. 4 may be split into controller portions 302*a* and 302*b*.

In the embodiment 303, a refill controller 302*a* is operatively coupled to the substantially constant flow rate node 106 to monitor pressure drop. Upon encountering a pressure drop, the refill controller 302*a* actuates control valve 210 to stop gas flow, reduce the pressure at node 208, and refill the abrasive tank 102 as described above. After the control valve 210 is shut off, control passes to the resume controller 302*b*, which is configured to open the control valve 210 to stop the flow of abrasive into and seal the abrasive tank 102, and resume propulsion of abrasive particles through the abrasive delivery tube 104. According to an embodiment, the resume controller 302*b* may include a timer configured to open the control valve 210 after a time delay corresponding to a desired amount of filling of the abrasive tank 102. The time delay may correspond to a time that allows the abrasive tank 102 to almost but not completely fill.

Figure 6:
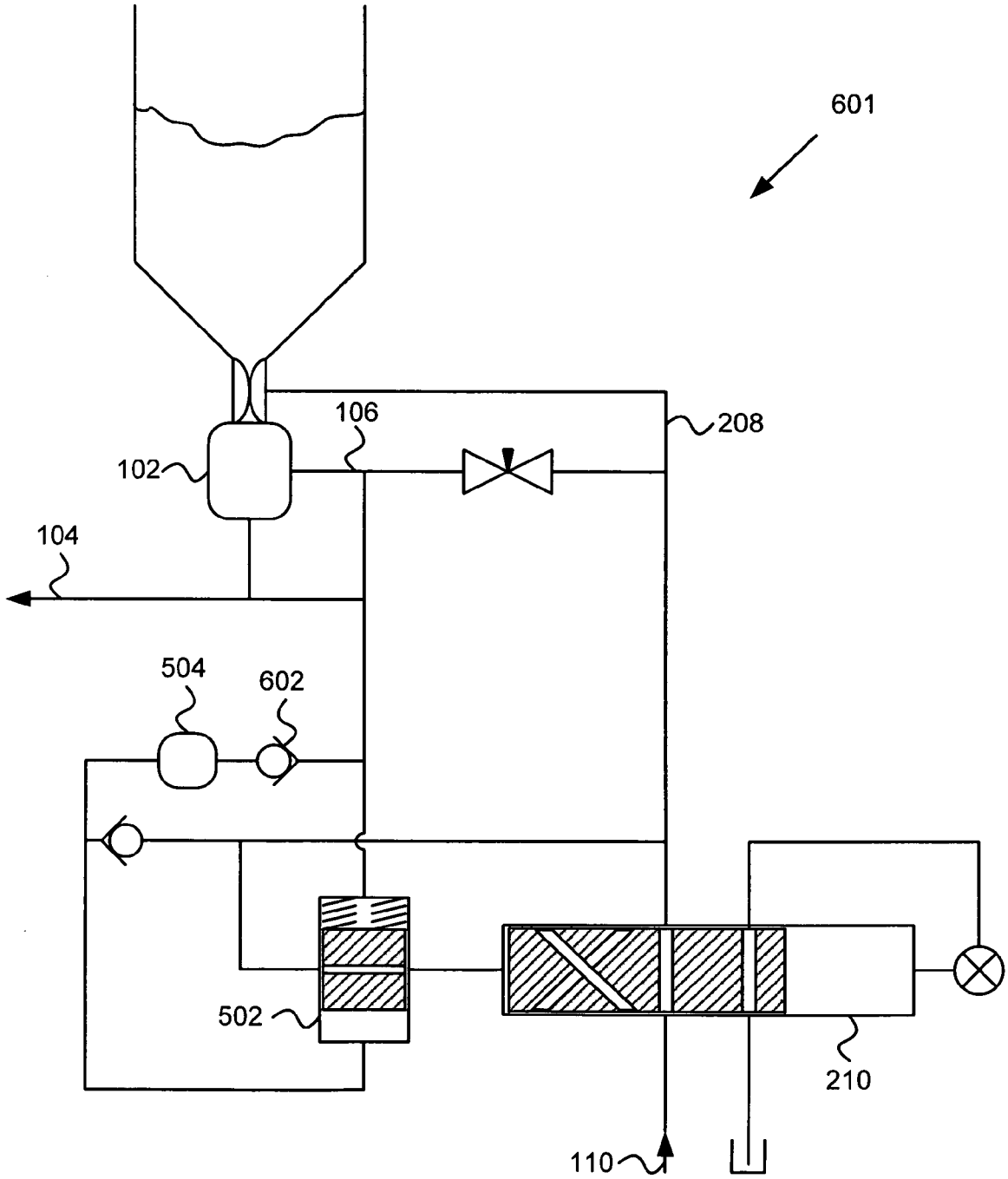
FIG. 6 is a diagram of the abrasive supply system of FIG. 5 at a moment corresponding to the end of the state of FIG. 5, according to an embodiment.
Figure 7:
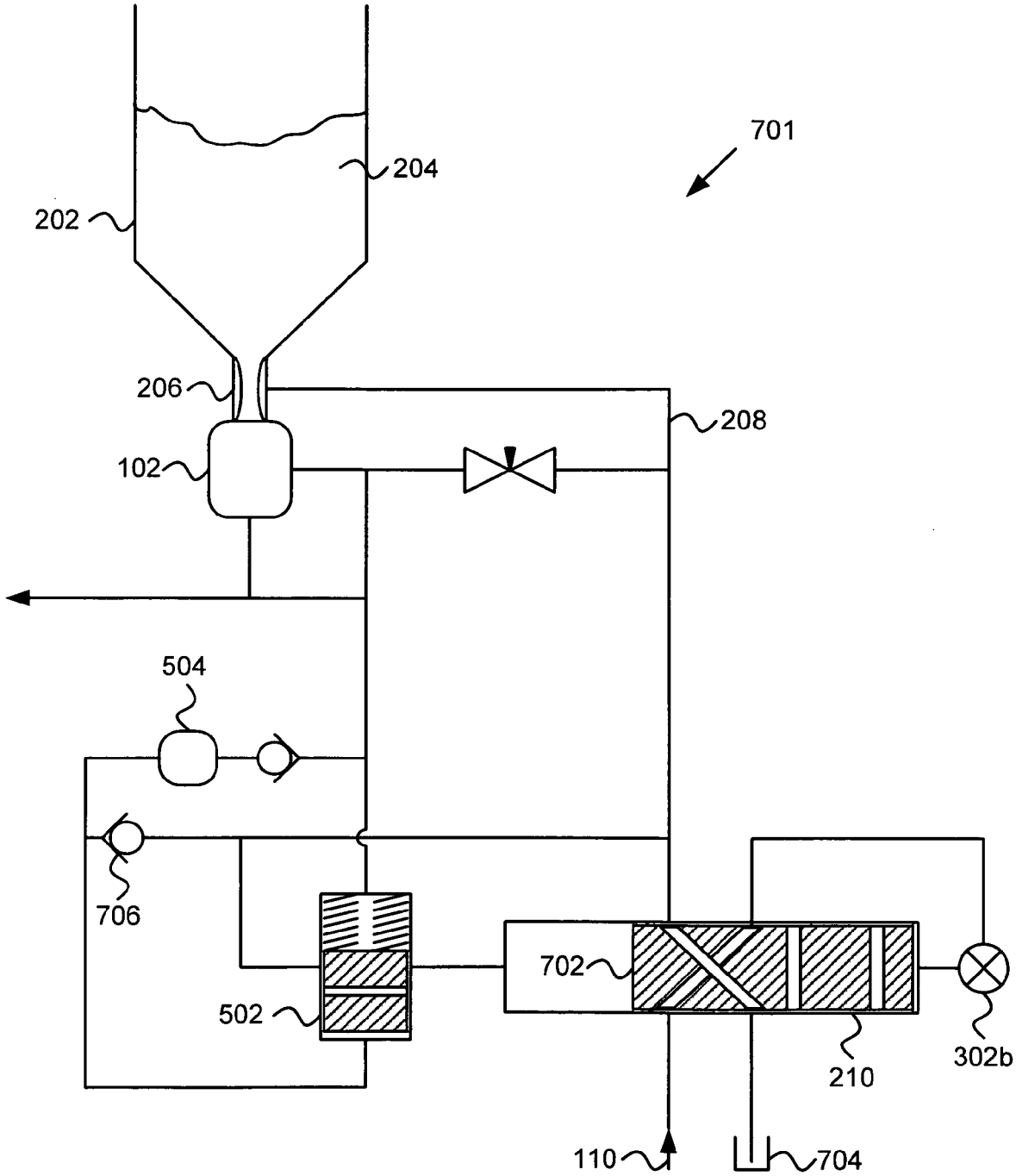
FIG. 7 is a diagram of the abrasive supply system of FIGS. 5 and 6 in a second state corresponding to refilling the abrasive tank that begins a moment after the configuration of FIG. 6, according to an embodiment.

According to some embodiments, the controller 302 (FIG. 3A), the refill controller 302*a*, and/or resume controller 302*b* (FIG. 3B), may be partly or completely constructed as pneumatic logic devices. For example, FIGS. 5-7 are a diagrams of states 501, 601, and 701 of an abrasive supply system with a pneumatic refill controller 302*a* and pneumatic resume controller 302*b* configured to actuate the control valve 210, according to embodiments.

Figure 5:
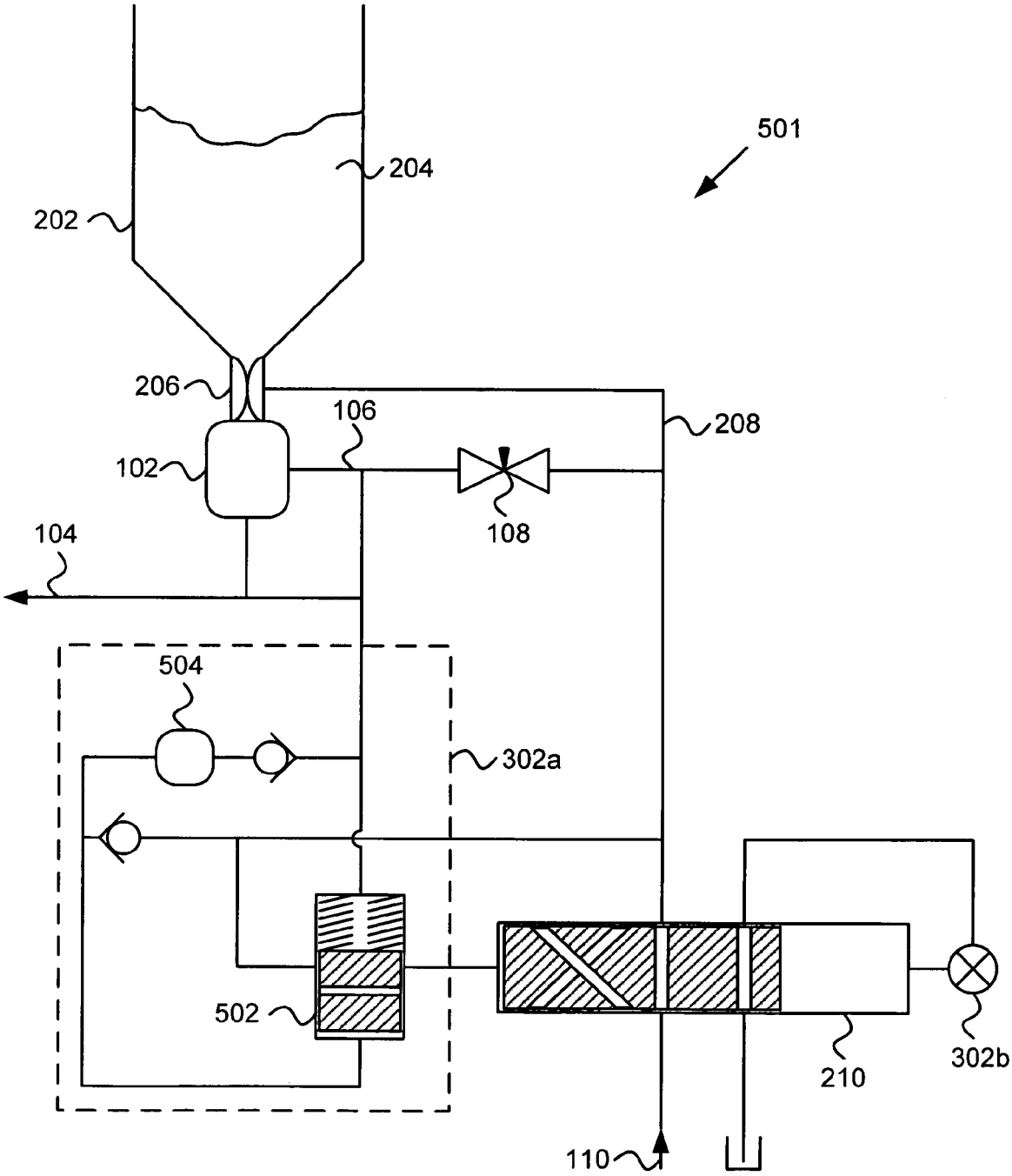
FIG. 5 is a diagram of an abrasive supply system with a pneumatic controller configured for automatic control of a substantially constant flow rate gas source and an abrasive supply valve in a first state, according to an embodiment.

Referring to FIG. 5, a gas source 110 is coupled to a substantially constant pressure node 208 via the supply valve 210. The pressure at node 208 keeps the abrasive supply valve 206 closed to isolate the (pressurized) abrasive tank 102 from the atmospheric pressure abrasive hopper 202 and prevent abrasive particles 204 from dropping into the abrasive tank 102. Simultaneously, the pressure at node 208 feeds the metering valve 108, which may be embodied as a needle valve, for example. The metering valve 108 admits a controlled flow rate of gas to form the substantially constant flow rate node 106, from which the gas may pressurize the abrasive tank 102 and propel abrasive particles through the abrasive delivery tube 104.

The abrasive hopper 202 is held substantially at atmospheric pressure, and may for example be a polyethylene hopper with a sloped bottom to urge the contained abrasive particles 204 to flow toward the bottom under gravity.

The refill controller 302*a* includes a pressure sensing valve 502 and a pressure tank 504 as shown. Normally, the pressure sensing valve 502 is biased closed by springs. The pressure from the substantially constant flow rate node 106 enters one side of the pressure sensing valve 502, and the pressure from the pressure tank enters the other side of the pressure sensing valve 502. During the state 501, corresponding to the state during step 406 of FIG. 4, these pressures are substantially equal, and the pressure sensing valve 502 remains closed. This keeps the control valve 210, embodied as a 4-way slide valve, in the position shown.

As described above, when the control valve 210 is open, abrasive particles flow from the abrasive tank 102 to the abrasive delivery tube 104. The substantially constant flow rate node 106, formed by the metering valve 108, propels the abrasive particles through the abrasive delivery tube 104, for example to a distal abrasive jet cutting nozzle. The friction of the abrasive particles against the walls of the abrasive delivery tube 104 causes the pressure at node 106 to increase to about 10 to 50 psig when the air is turned on at node 208. Abrasive continues entering the abrasive delivery tube 104 from the abrasive tank 102 until the abrasive tank is emptied, when the missing abrasive causes a reduction in back pressure from the abrasive delivery tube 104. According to an embodiment, state 501 is typically maintained for about 1-3 minutes per cycle.

FIG. 6 is a diagram of a state 601 corresponding to the moment that pressure reduction at node 106 causes the pressure sensing valve 502 to actuate a change in the state of the control valve 210. A check valve 602 admits gas pressure from the node 106 into the pressure tank 504, but does not allow the pressure within the pressure tank to bleed out through the abrasive delivery tube 104 when the back pressure therein is reduced. The maintained pressure in the pressure tank 504 actuates the pressure sensing valve 502 when the pressure from node 106 plus the spring bias pressure is no longer sufficient to hold the valve shut against the pressure in the pressure tank 504. The pressure sensing valve 502 admits the pressure from node 208, which is still at the pressure of the gas source 110, to the left side of the control valve 210 as shown. Typically, the pressure sensing valve 502 remains open for about 250 milliseconds per cycle.

FIG. 7 is a diagram of a state 701 that begins a moment after the pressure sensing valve 502 has actuated the control valve 210, according to an embodiment. A valve body 702 in the control valve 210 is forced to the right by the pressure admitted by the pressure sensing valve 502. As the valve body 702 slides to the right, it couples the substantially constant pressure node 208 to a vent 704 and the pressure at node 208 rapidly drops to atmospheric. A check valve 706 vents the pressure from tank 504 to node 208 and to the vent 704, which allows the spring bias pressure to close the pressure sensing valve 502. The pressure drop at node 208 allows the abrasive supply valve 206 to open to allow abrasive particles 204 to flow under gravity from the abrasive hopper 202 into the abrasive tank 102.

Substantially simultaneously, the valve body 702 couples the gas source 110 to the resume controller 302*b*. According to the embodiment of FIG. 7, the resume controller includes a timer valve that remains closed for a predetermined period of time, and then opens. The delay time is selected to allow the abrasive tank 102 to almost, but not quite fill with abrasive. When the timer valve 302*b* opens, air pressure from the air source 110 presses against the right side of the valve body 702, causing it to slide to the left and the system to reenter state 501 of FIG. 1.

According to embodiments, several advantages may be realized compared to earlier systems that used a pressurized abrasive hopper 202:

- The manufacturing cost may be much lower
- Shipping cost may be lower
- The abrasive (e.g. garnet) level may be viewed through the translucent polyethelene
- The air flow propelling the abrasive is limited so that it may generally not blow abrasive out of the small hopper at the cutting nozzle (at the distal end of the abrasive delivery tube 104).
- no electrical connection is required There are no or minimal code requirements for the small pressure vessel.

With respect to the appended claims, those skilled in the art will appreciate that recited operations therein may generally be performed in any order. Examples of such alternate orderings may include overlapping, interleaved, interrupted, reordered, incremental, preparatory, supplemental, simultaneous, reverse, or other variant orderings, unless context dictates otherwise. With respect to context, even terms like "responsive to," "related to," or other past-tense adjectives are generally not intended to exclude such variants, unless context dictates otherwise.

While various aspects and embodiments have been disclosed herein, other aspects and embodiments will be apparent to those skilled in the art. The various aspects and embodiments disclosed herein are for purposes of illustration and are not intended to be limiting, with the true scope and spirit being indicated by the following claims.

I claim:

1. An abrasive supply system, comprising:

an abrasive tank configured to hold abrasive particles;

a substantially atmospheric pressure abrasive hopper configured to selectively deliver abrasive particles to the abrasive tank;

an abrasive delivery tube operatively coupled to the abrasive tank and configured to convey gas-entrained abrasive particles; and a substantially constant flow rate gas source configured to pressurize the abrasive tank and propel abrasive particles through the abrasive delivery tube;

wherein the abrasive supply system is configured for cooperation between the substantially constant flow rate gas source, the abrasive tank, and the abrasive delivery tube to automatically detect a reduced amount of abrasive in the abrasive tank, responsively depressurize the abrasive tank, and refill the abrasive tank with abrasive particles from the abrasive hopper.

2. The abrasive supply system of claim 1 wherein the substantially constant flow rate is selected to allow the pressure in the abrasive tank to decrease when the abrasive tank is emptied.

3. The abrasive supply system of claim 1, further comprising:

a metering valve configured to provide the substantially constant flow rate gas source from a substantially constant pressure gas source.

4. The abrasive supply system of claim 1, further comprising:

an abrasive supply valve configured to selectively admit abrasive particles from the abrasive hopper to the abrasive tank.

5. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank; and a control valve configured to selectively close the abrasive supply valve when there is gas flow through the metering valve or open the abrasive supply valve when there is substantially no gas flow through the metering valve.

6. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a controller configured to receive a pressure signal from the substantially constant flow gas source and, responsive to the pressure signal, actuate the control valve to stop gas flow through the metering valve and open the abrasive supply valve.

7. The abrasive supply system of claim 6, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a controller configured to receive a pressure signal from the substantially constant flow gas source and, responsive to the pressure signal, actuate the control valve to stop gas flow through the metering valve and open the abrasive supply valve, and subsequently actuate the control valve to close the abrasive supply valve and start the gas flow through the metering valve again.

8. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a controller including a pneumatic logic circuit configured to receive a pressure signal from the substantially constant flow gas source and, responsive to the pressure signal, actuate the control valve to stop gas flow through the metering valve and open the abrasive supply valve.

9. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a controller including a pressure sensor valve configured to receive a pressure signal from the substantially constant flow gas source and, responsive to the pressure signal, actuate the control valve to stop gas flow through the metering valve and open the abrasive supply valve.

10. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a first controller portion configured to receive a pressure signal from the substantially constant flow gas source and, responsive to the pressure signal, actuate the control valve to stop gas flow through the metering valve and open the abrasive supply valve; and a reset mechanism configured to actuate the control valve to start gas flow through the metering valve and close the abrasive supply valve after abrasive particles flow from the abrasive hopper to the abrasive tank.

11. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a first controller portion configured to receive a pressure signal from the substantially constant flow gas source and, responsive to the pressure signal, actuate the control valve to stop gas flow through the metering valve and open the abrasive supply valve; and a reset mechanism including a timing mechanism configured to actuate the control valve to start gas flow through the metering valve and close the abrasive supply valve after a period of time has passed.

12. The abrasive supply system of claim 1, further comprising:

a metering valve configured to provide the substantially constant flow rate gas source from a substantially constant pressure gas source;

an abrasive supply valve configured to selectively admit abrasive particles from the abrasive hopper to the abrasive tank;

a control valve configured to selectively close the abrasive supply valve when there is gas flow through the metering valve or open the abrasive supply valve when there is substantially no gas flow through the metering valve; and a first controller portion configured to receive a pressure signal from the substantially constant flow gas source and, responsive to the pressure signal, actuate the control valve to stop gas flow through the metering valve and open the abrasive supply valve; and a time-delay valve configured to receive gas pressure when the control valve stops gas flow to the metering valve and reset the control valve to restart gas flow to the metering valve after a time delay.

13. A method for delivering abrasive to a nozzle, comprising:

in a first operating mode, pressurizing an abrasive tank and propelling abrasive particles from the abrasive tank through an abrasive delivery tube with a substantially constant flow rate gas source; and automatically detecting a reduced amount of abrasive in the abrasive tank and entering a second mode to depressurize the abrasive tank and refill the abrasive tank with abrasive particles from a substantially atmospheric pressure abrasive hopper.

14. The method of claim 13, further comprising providing the substantially constant flow rate gas source by metering a substantially constant pressure gas source through a metering valve configured to provide a substantially constant flow rate.

15. The method of claim 13, wherein the reduced amount of abrasive in the abrasive tank is indicated by a reduced gas pressure at a node corresponding to the substantially constant flow rate gas source.

16. The method of claim 13, wherein the reduced amount of abrasive in the abrasive tank is indicated by a reduced gas pressure at a pressure node corresponding to the substantially constant flow rate gas source; and wherein automatically detecting a reduced amount of abrasive in the abrasive tank is performed by a pressure sensing valve configured to compare a maximum pressure reached at the pressure node with a current pressure at the pressure node.

17. The method of claim 16 wherein the pressure sensing valve actuates a control valve to transition from the first operating mode to the second operating mode.

18. The method of claim 16 wherein the pressure sensing valve actuates a control valve to transition from the first operating mode to the second operating mode, and the control valve closes to remove pressure from a feed side of a metering valve configured to provide the substantially constant flow rate gas source.

19. The method of claim 16 wherein the pressure sensing valve actuates a control valve to transition from the first operating mode to the second operating mode, and the control valve closes to remove pressure from a feed side of a metering valve configured to provide the substantially constant flow rate gas source; and wherein the removal of pressure from the feed side of the metering valve also removes pressure from the substantially constant flow rate gas source and the abrasive tank.

20. The method of claim 16 wherein the pressure sensing valve actuates a control valve to transition from the first operating mode to the second operating mode, and the control valve closes to remove pressure from a feed side of a metering valve configured to provide the substantially constant flow rate gas source and open an abrasive feed valve to allow the abrasive particles to flow from the substantially atmospheric pressure abrasive hopper to the abrasive tank.

21. The method of claim 16 wherein the pressure sensing valve actuates a control valve to transition from the first operating mode to the second operating mode and wherein actuation of the control valve also provides gas pressure to a timer valve.

22. The method of claim 21:

wherein the pressure sensing valve actuates a control valve to transition from the first operating mode to the second operating mode;

wherein actuation of the control valve also provides gas pressure to a timer valve; and wherein the timer valve actuates the control valve to transition from the second operating mode to the first operating mode.

23. An abrasive jet cutting system, comprising:

a cutting nozzle; and an abrasive delivery system configured to convey abrasive particles from an atmospheric pressure abrasive hopper to the cutting nozzle, the abrasive delivery system further including:

an abrasive tank coupled to receive abrasive particles from the abrasive hopper;

an abrasive supply valve configured to control the flow of abrasive particles from the abrasive hopper to the abrasive tank;

a substantially constant flow rate gas source configured to pressurize the abrasive tank and propel abrasive particles to the cutting nozzle; and a pneumatic controller configured to sense a depletion of abrasive particles from the abrasive tank, responsively stop the substantially constant flow rate gas source and open the abrasive control valve, and subsequently start the substantially constant flow rate gas source and close the abrasive control valve.

24. The abrasive jet cutting system of claim 23, wherein the atmospheric pressure abrasive hopper is configured to allow visual inspection of its contents.

25. The abrasive jet cutting system of claim 23, wherein the atmospheric pressure abrasive hopper is constructed at least partially from at least one selected from the group consisting of polyethylene, high density polyethylene, polypropylene, high density polypropylene, polybutyldiene, and polyvinylchloride.

* * * * *